US011007395B2

(12) United States Patent
D'Alesio

(10) Patent No.: US 11,007,395 B2
(45) Date of Patent: May 18, 2021

(54) EXERCISE DEVICE AND SPORTING EQUIPMENT WITH SAID DEVICE

(71) Applicant: REAXING S.R.L., Milan (IT)

(72) Inventor: Gionata D'Alesio, Ascoli Piceno (IT)

(73) Assignee: REAXING S.R.L., Milan (IT)

( * ) Notice: Subject to any disclaimer, the term of this patent is extended or adjusted under 35 U.S.C. 154(b) by 68 days.

(21) Appl. No.: 16/091,738

(22) PCT Filed: Apr. 5, 2017

(86) PCT No.: PCT/IB2017/051956

§ 371 (c)(1),
(2) Date: Oct. 5, 2018

(87) PCT Pub. No.: WO2017/175152

PCT Pub. Date: Oct. 12, 2017

(65) Prior Publication Data

US 2019/0118026 A1 Apr. 25, 2019

(30) Foreign Application Priority Data

Apr. 6, 2016 (IT) ..... UA2016A002185
Mar. 7, 2017 (IT) ..... UA2017A001546

(51) Int. Cl.
*A63B 21/072* (2006.01)
*A63B 21/08* (2006.01)
(Continued)

(52) U.S. Cl.
CPC ..... *A63B 21/0728* (2013.01); *A63B 21/0004* (2013.01); *A63B 21/00069* (2013.01);
(Continued)

(58) Field of Classification Search
CPC ..... A63B 21/0608; A63B 21/072–075; A63B 21/0004; A63B 21/0435–0442; A63B 21/0557; A63B 21/08
See application file for complete search history.

(56) References Cited

U.S. PATENT DOCUMENTS 825,955 A * 7/1906 Bohache ..... A63B 21/075 482/108
3,182,999 A 5/1965 Updaw
(Continued)

FOREIGN PATENT DOCUMENTS

GB 2 480 892 12/2011

OTHER PUBLICATIONS

International Search Report, PCT/IB2017/051956, dated Aug. 23, 2017.
Written Opinion, PCT/IB2017/051956, dated Aug. 23, 2017.

*Primary Examiner* — Jennifer Robertson
(74) *Attorney, Agent, or Firm* — Nixon & Vanderhye

(57) ABSTRACT

Exercise device for a sporting device, including at least a fixed structure and a movable element and optionally a mass hanging from the movable element, wherein: a) the fixed structure, extending at least partially longitudinally along an axis X, is connectable by way of an end portion to a portion of a rod of the sporting device, this structure including at least one limit stop positioned at the free end or between the free end and the movable element, and b) a movable element connectable to the fixed structure and adapted to carry out at least a sliding translation movement with respect to the fixed structure along the axis X.

20 Claims, 6 Drawing Sheets

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/06*** | (2006.01) |
| ***A63B 21/075*** | (2006.01) |

(52) U.S. Cl.

CPC ..... *A63B 21/0442* (2013.01); *A63B 21/0557* (2013.01); *A63B 21/0608* (2013.01); *A63B 21/072* (2013.01); *A63B 21/075* (2013.01); *A63B 21/08* (2013.01); *A63B 21/4035* (2015.10); *A63B 21/00061* (2013.01); *A63B 2208/0204* (2013.01); *A63B 2225/09* (2013.01)

(56) References Cited

U.S. PATENT DOCUMENTS

| | | | | |
|---|---|---|---|---|
| 3,672,093 | A | 6/1972 | Meek | |
| 4,637,606 | A | 1/1987 | Hunn | |
| 4,787,623 | A | 11/1988 | Cedar | |
| 6,402,668 | B1 * | 6/2002 | Harker | A63B 21/0004 482/121 |
| 9,089,756 | B1 * | 7/2015 | Kirschberg | A63B 69/3632 |
| 9,943,738 | B2 * | 4/2018 | Edge | A63B 67/10 |
| 2011/0077133 | A1 | 3/2011 | Oesterling | |

* cited by examiner

EXERCISE DEVICE AND SPORTING EQUIPMENT WITH SAID DEVICE

BACKGROUND OF THE INVENTION

Field of the Invention

The present invention relates to an exercise device for a sporting device. More in particular, it concerns a device for a sporting device to be gripped, such as a barbell. Even more in particular, the invention deals with a device that allows physical exercises to be performed with equipment in non-static position, mainly involving the arm muscles.

The invention falls within the sector of sporting equipment suitable to stimulate the reaction of the human body to so-called motor interferences, i.e. external stimuli that, during the performance of a movement, can generate a variation of the balance of a person.

Description of the Related Art

Usually, training of the muscles of the body involves the performance of free body exercises or exercises with equipment (movable devices or stationary machines).

While performing these exercises, the person handles a device with a fixed configuration for the whole of the exercise.

A person training with these devices voluntarily contracts his/her muscles to carry out a given movement typical of the exercise being performed.

In practice, during the performance of an exercise, any variation of position or speed of a part of the body, just as the force exerted by given muscles, is known or in any case predictable by the person carrying out the exercise.

However, both in the practice of some sporting activities and in normal daily actions, our body is often subjected to external stimuli, predictable or unpredictable, that can interfere with a movement that is being performed or with a condition of stable balance. These interferences can be generated, for example, by a strong gust of wind or a sudden and unexpected movement of the axis of the body or of the weight of the object to be grasped.

In general, the greater the rapidity and unpredictability of the interference that occurs, the more difficulty the body has in reacting correctly to re-establish the condition of movement, or of unperturbed balance.

In this regard, studies by Shumway-Cook A. and collaborators, Nasher L. M. and collaborators, and Mollroy and collaborators show that this capacity of our body to react can be developed and increased with a training method in which motor interferences are suitably imparted to the person during the performance of physical exercises.

Today this capacity is developed by means of proprioceptive equipment.

As a function of his/her proprioceptive capacity, a person may therefore be able, or unable, to predict, and optionally prevent, said loss of balance.

BRIEF SUMMARY OF THE INVENTION

The main object set and achieved with the present invention is to provide a device that allows a person to perform a physical exercise perturbed by motor interferences that are unexpected and that change in an unknown manner.

In particular, an object of the invention is to provide a device capable of generating motor interferences that cannot be controlled, or can only partially be controlled, by the person during the performance of the exercise.

The purpose of this device is, therefore, that of reproducing motor interferences to which a person in daily life, or an athlete during the performance of a sporting activity, could be subjected.

A further object of the present invention is to propose a device that is inexpensive and simple to produce.

Another object of the present invention is to produce a versatile device that can be used for professional or amateur training, for various sporting disciplines or for rehabilitation.

Yet another object of the present invention is to provide a practical device that can also be used by beginners or inexperienced users.

The aforesaid objects are achieved with an exercise device provided with at least one component that, being movable during the performance of a physical exercise, is subject to a movement that can be sudden and, therefore, potentially destabilizing for the balance of the person carrying out this exercise.

The present invention therefore relates to an exercise device connectable to a sporting device in which said sporting device comprises at least one portion in the form of a rod.

The device according to the invention comprises at least a fixed structure and a movable element.

The fixed structure extends at least partially longitudinally along an axis X and is connectable by means of an end portion to said rod portion of the sporting device. This fixed structure, in turn, comprises at least one limit stop, positioned at a free end thereof or between said free end and said movable element.

The movable element is connectable to said fixed structure so as to carry out at least a sliding translation movement with respect to the fixed structure along said axis X.

The movable element, as will be explained in greater detail below, is connectable to a mass or the like. More in particular, said mass can be hung from the movable element, for example by means of a spacer or suspension element.

When the device is used by a person in an exercise, the movable element, which can slide on the fixed structure, varies the point of application of the weight of the mass on the device causing a sudden and unexpected destabilizing effect, i.e. a motor interference, for the person using the device.

According to the present invention, in said device the fixed structure comprises at least one portion in the form of a bar, preferably with a cylindrical cross section along the axis X, and an end portion.

More in detail, this structure has, on one side, a free end, optionally carrying a limit stop and, on the opposite side, an end portion.

The device according to the present invention can be formed in once piece with a portion of a rod of said sporting device or the device can be interchangeable. In this latter case, the device is connectable to this rod portion of said sporting device by means of the end portion, which in this case acts as coupling portion.

According to the present invention, said device also comprises an element movable along the portion in the form of a bar of the fixed structure.

This movable element can be symmetrical or asymmetrical with respect to said axis X.

Sliding of the movable element on the fixed structure is guaranteed, for example, by bearing means, included in this movable element. These latter are typically selected from a bushing made of a plastic or metal material or roller or ball bearings.

Advantageously, with the aid of the bearing means, the movable element can also perform a rotation movement about the axis X, in addition to the aforesaid sliding movement along the axis X of the fixed structure.

The device of the present invention also comprises a limit stop, hereinafter indicated as first limit stop. This limit stop can be non-movable and positioned in said fixed structure at the free end of the portion in the form of a bar, i.e. the opposite end with respect to the end carrying the end portion.

According to an alternative embodiment, the first limit stop can be movable along the axis X of the structure and fixable in a position selected by the user of the device between the free end of the portion in the form of a bar and said movable element.

The methods for fastening said first limit stop to the structure are known to a person skilled in the art. For example, the limit stop is blocked with a nut, in this case the free end part can be threaded.

According to an embodiment in which the device is interchangeable and, consequently, the end portion forms the coupling portion, this latter can consist of a cavity open at the end of the fixed structure. The portion of a rod of said sporting device is housed in this cavity. The hollow end of the fixed structure can, for example, be threaded so that it can be fastened to said portion, also threaded, for example, of rod of said sporting device. Naturally, other methods of fastening are possible.

According to a specific embodiment, the movable element comprises a sleeve inserted sliding on said bar. In this configuration, the bearing means project in the through cavity of the sleeve into which said bar is inserted.

According to a preferred variant, the device comprises a second limit stop positioned between said end portion and said movable element.

In a preferred embodiment, this second limit stop is of movable type. This limit stop can be formed as a component comprising a threaded bushing screwed onto a threaded portion of the portion in the form of a bar of the fixed structure.

According to the embodiments, the device can have a single movable limit stop or both limit stops can be movable.

In fact, the limit stops act as limiters of the range of travel of the movable element. The fact that the limit stops can move makes it possible to delimit the translation travel of the movable element as required, i.e. to choose the length of the movement of the movable element in the direction of translation. Therefore, by means of one or both of the limit stops, the length of said translation travel can be varied.

According to another variant, an elastic element, such as a spring, an elastomeric pad, an elastic tape or the like, is interposed between the movable element and at least one of the limit stops. Therefore, said elastic element opposes the movement of the movable element when this latter tends to compress it or, on the contrary, to extend it. This elastic element thus acts as limiter of the travel of the movable element. Preferably, the device comprises two elastic elements, each interposed between the movable element and one of the limit stops with the aim of limiting the travel of the movable element in both directions of sliding between the limit stops.

According to a further preferred embodiment, the movable element is provided with adjustable braking means to slow, with greater or lesser intensity, the movement of the movable element on the bar of the fixed structure. In this way it is possible to adjust the intensity of the interference action that the exercise device imparts to the person.

Optionally, said braking means can be integrated with the bearing means so as to allow the movable element to slide freely or be partially braked, according to needs.

In a preferred variant, the device also comprises a mass hanging from said fixed structure. More in particular, the mass is hanging from the movable element of the fixed structure. Said mass can be connected to the movable element directly or, preferably, by means of a spacer means of rigid type, such as a rod, or of flexible type, such as a string or a tape. This spacer means makes it possible to generate motor interferences oriented differently in space.

If the mass or both the mass and this spacer means are present, they are joined, respectively, according to the embodiment, to the movable element or, at one end to the movable element and at the opposite end to the mass, according to any of the methods known to a person skilled in the art.

In this embodiment, the movable element is provided with a seat or with a coupling means, for example a hook or ring, to which to connect, directly or preferably indirectly, said mass. This latter is usually provided with a specific coupling means complementary to the means positioned on the movable element, for example a ring or hook, respectively.

As these coupling means are well know to a person skilled in the art, they will not be described in further detail hereinafter in the description.

Said mass takes the form of a solid body, which is generally spherical in shape, for example a medicine ball that can have different weight values. Naturally, this body can also take other forms of solid bodies, such as a disc, a cylinder or the like. Moreover, this mass can have any weight, selected by the person performing the exercise.

According to a particularly preferred embodiment, the flexible means is also elastic, i.e. it can extend or retract depending on the load applied thereto.

This flexible and elastic means can, for example, be in the form of a metal spring, of a string or of a tape made of elastic material, or of a band of elastic strings grouped together.

The flexible and elastic means is preferably connected to the mass in a point thereof as far as possible from the device, so as to make use of the elastic properties of the spacer means and thereby limit its length. Advantageously, during use of the device, this elastic means also allows motor interferences to be generated along a substantially vertical direction.

In a further preferred embodiment, a through hole in which at least one portion of said flexible elastic means is housed passes through said body for the whole of one of its dimensions, usually width or length. This hole typically has a first opening, defined inlet opening, and a second opening, defined outlet opening, to allow the spacer means to be inserted therein and, optionally, exit therefrom. This latter can be fastened in any point of the through hole or, preferably, at the level of the outlet opening.

According to another variant of the invention, the aforesaid spacer means comprises an elongated flexible element connected at one end to the device and which, at the opposite end, has a housing for a mass, typically in the form of a ball. Said housing comprises at least two bands adapted to surround the perimeter of the mass along two directions crossing over each other, so as to retain this mass.

BRIEF DESCRIPTION OF THE DRAWINGS

Further features and details of the invention will be better understood from the description below, provided by way of non-limiting example, and from the accompanying drawings, wherein:

With reference to FIG. 1, the reference numeral 1 indicates as a whole the interchangeable device according to an embodiment of the present invention.

DETAILED DESCRIPTION OF THE PREFERRED EMBODIMENTS

Figure 1A:
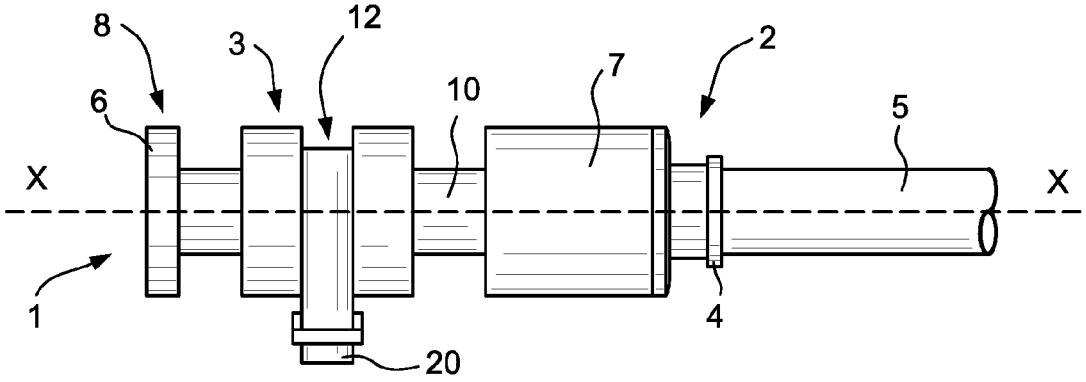
FIGS. 1*a*, 1*b* and 1*c* are representations of side views of the device according to an embodiment of the present invention.

FIG. 1*a* illustrates the device according to the present invention, in which the first limit stop 6, at the free end 8, is fixed and integral with the bar 10. The second limit stop 7 instead comprises a threaded bushing that can be screwed onto a threaded portion 11 integral with the bar 10. Therefore, the second limit stop can move along the axis X as a function of the extent to which the threaded bushing is screwed onto the threaded portion 11.

In the example of FIG. 1*a*, said threaded bushing 7 is completely screwed onto the threaded portion 11. In this configuration, the movable element 3 has available the maximum sliding length along the bar 10 between the limit stops 6 and 7.

Figure 1B:
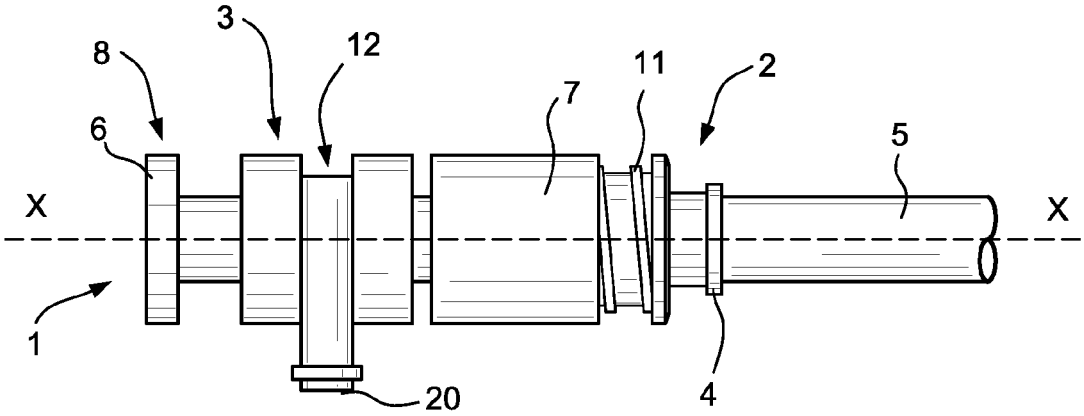
Figure 1C:
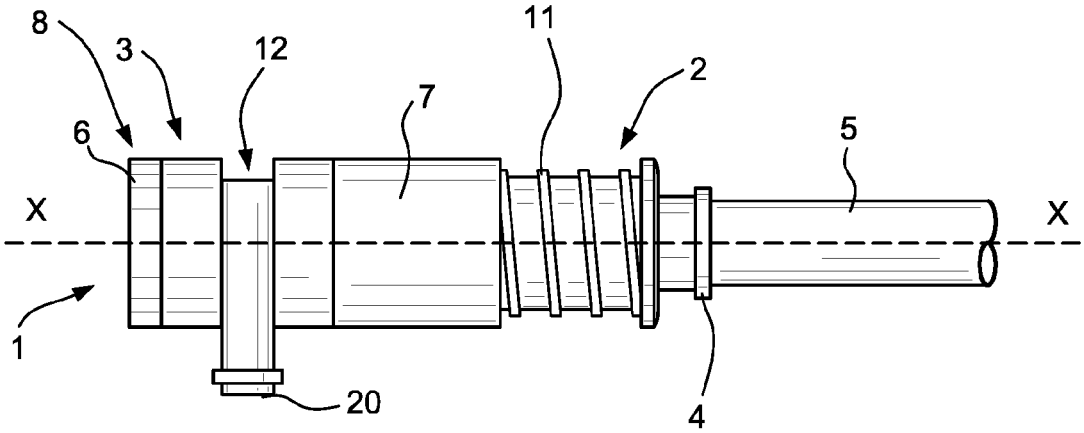

In FIGS. 1*b* and 1*c* the bushing 7 is moved with respect to the illustration of FIG. 1*a* and is closer to the first limit stop 6. The movable element 3 has available a smaller portion (FIG. 1*b*) of the bar 10 on which to slide or is blocked against the first limit stop 6 (FIG. 1*c*).

According to a preferred embodiment, the movable element 3 is provided with bearing means (not visible in the accompanying figures). Sliding of said bearing means on the outer surface of said bar 10 of the fixed structure 2 allows the movable element 3 to be moved along the bar 10.

In the embodiment illustrated in the accompanying figures, the movable element 3, of symmetrical type, is provided with a seat 12 to which to connect the mass 9 by means of the spacer means 20, such as a tape or a cord.

As mentioned previously, movement of the movable element 3 along the bar 10 causes movement of the point of application of the weight of the mass 9 connected to the spacer element 20. This movement causes a different distribution of the load that weighs on the person performing the exercise, generating a motor interference.

The movement of the movable element 3 is generally free, or optionally braked. Therefore, the person performing the exercise is not able to predict its movement and, consequently, to predict the variation of the load of the device. In these conditions the person is subject to sudden and unexpected motor interferences.

Figure 2A:
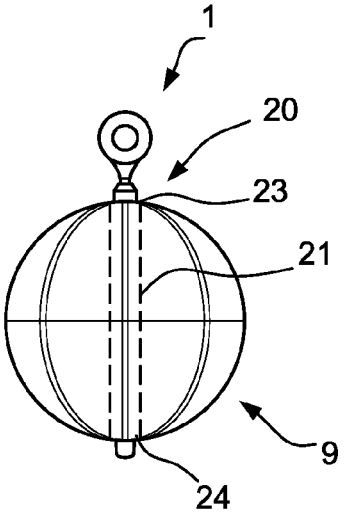
FIGS. 2*a*, 2*b* and 2*c* are representations of front views of the device according to a further embodiment of the present invention.
Figure 2B:
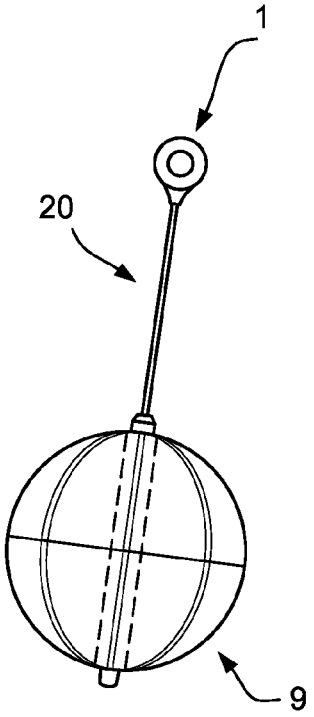
Figure 2C:
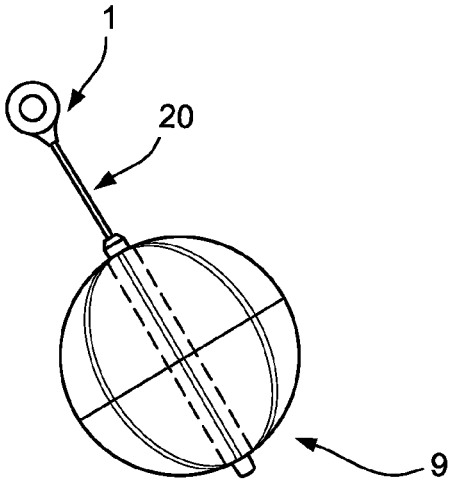
Figure 3A:
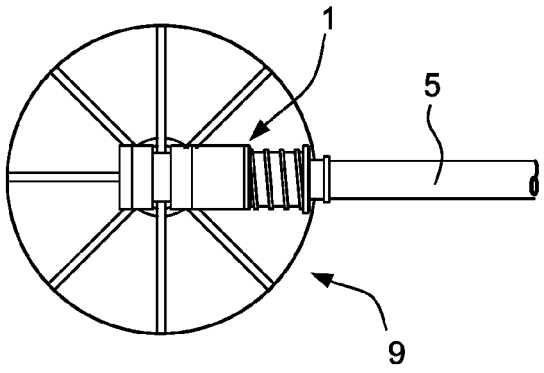
FIGS. 3*a*, 3*b*, 3*c*, 3*d* and 3*e* are representations of top views of the device according to the embodiment of the present invention illustrated in FIGS. 2*a*, 2*b* and 2*c;*
Figure 3B:
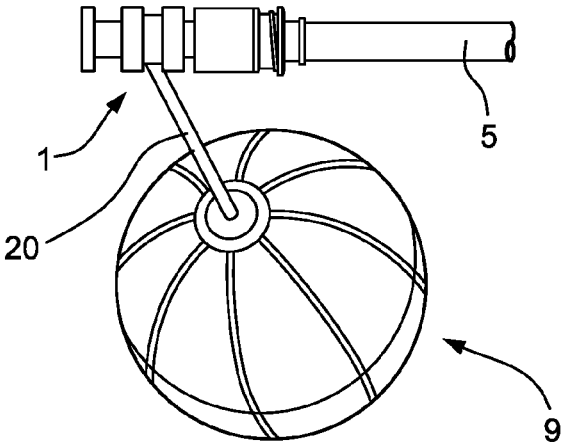
Figure 3C:
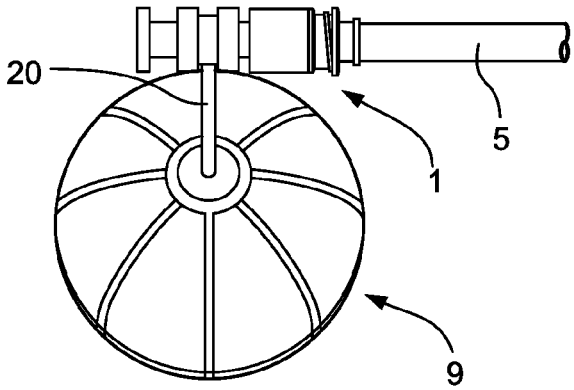
Figure 3D:
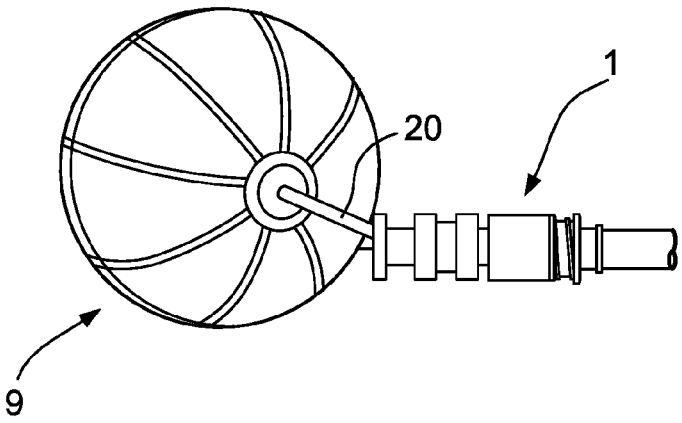
Figure 3E:
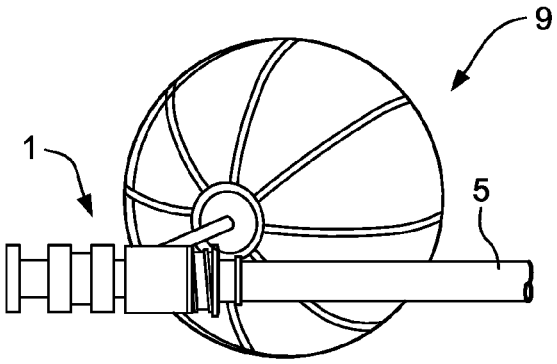

In particular, the accompanying FIGS. 2 and 3 illustrate, respectively, the oscillation and rotation movements of the mass 9 during an exercise. In these examples illustrated, the mass 9, spherical in shape, is for example a medicine ball.

In this latter embodiment, the tape is elastic for the purpose of also allowing the mass to perform a stretching movement, in addition to the translation movement and, optionally, to the rotation movement about the axis X of the fixed structure 2.

Figure 4A:
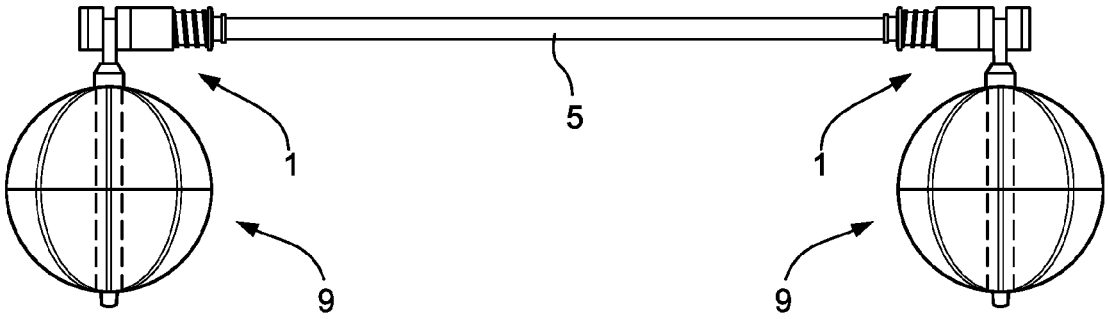
FIGS. 4*a*, 4*b* and 4*c* are representations of side views of the device according to a further embodiment of the present invention.
Figure 4B:
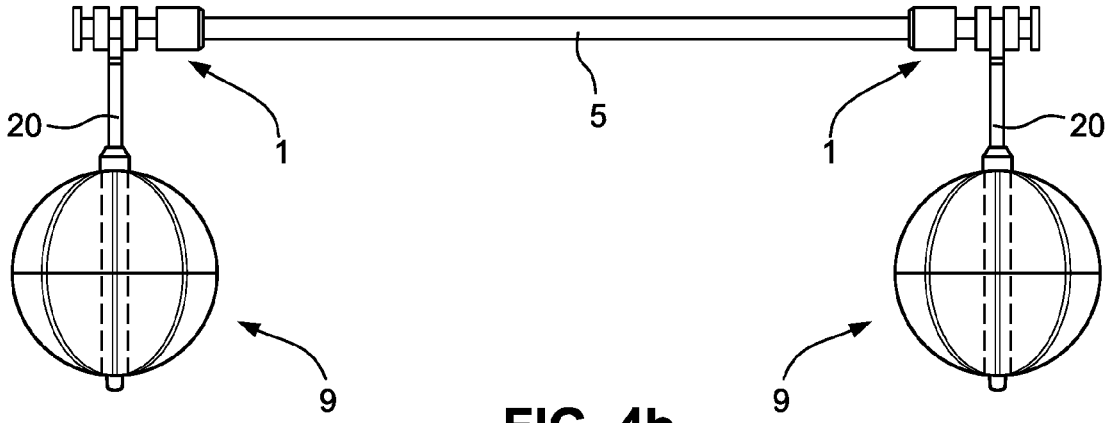
Figure 4C:
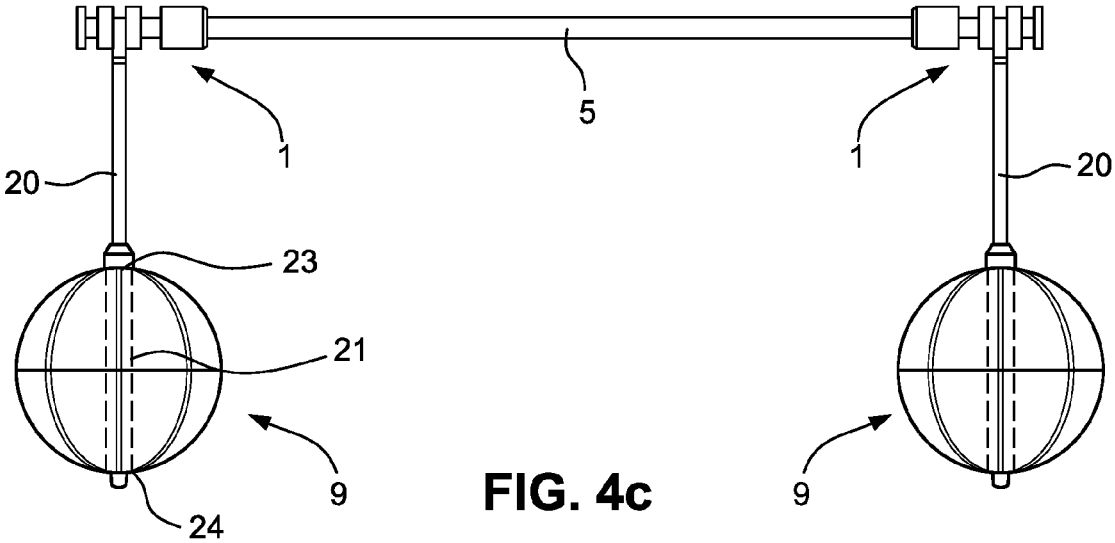

FIGS. 4*a*, 4*b* and 4*c* illustrate an exercise device 100 in the form of a bar or barbell, at the ends of which the exercise device 1 is fastened.

In turn, the exercise device is connected to the spacer means 20, flexible and preferably elastic, that supports the mass 9, for example the medicine ball as in the example illustrated.

As can be seen in the aforesaid figure, the medicine ball can be moved to different distances from the body of the device as a function of the extent to which the elastic element 20 is stretched.

In a preferred embodiment, to make the most of the elastic potentials of the elastic spacer means, said ball 9 comprises a through hole 21 in which at least one portion of said tape 20 is housed. More in particular, a through hole 21, having an inlet opening 23 at one end of said through hole 21 and an outlet opening at 24 at the opposite end of this through hole 21 passes diametrically through the ball 9 (FIGS. 2*a*, 4*c*. Said tape 20, which is only fastened at the level of the outlet opening 24, is inserted into this hole 21, as can be seen in FIGS. 2*a*, 2*b*, 2*c* and 4*a*, 4*b* and 4*c*.

Figure 5:
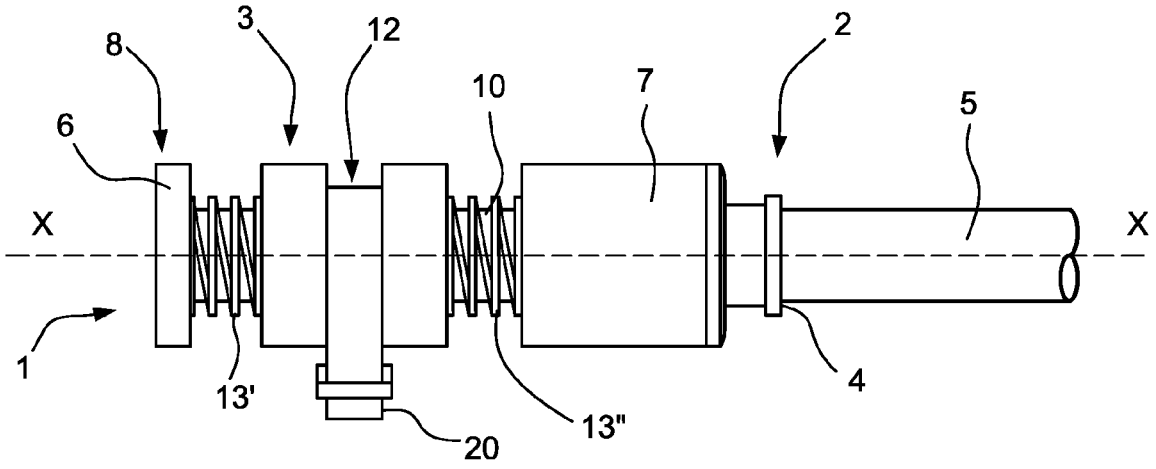
FIG. 5 is a side view of the device according to another embodiment of the present invention.

FIG. 5 illustrates another variant of the device according to the invention.

In this variant the device is substantially identical to the one illustrated with reference to FIGS. 1*a*-1*c*. In addition, the device comprises at least one elastic element 13, typically a spring, interposed between the movable element 3 and at least one of the limit stops 6, 7. Alternatively, the elastic element 13 can be an elastomeric pad or an elastic tape.

This elastic element 13 opposes the movement of the movable element 3 exerting thereon a thrust to maintain it in a position at rest, more or less stable as a function of the rigidity of said elastic element. Therefore, this elastic element acts as limiter of the travel of the movable element 13.

In the variant illustrated, the device comprises two elastic elements 13', 13" each interposed between the movable element 3 and the limit stops 6 and 7, respectively.

According to this variant, the elastic elements 13 exert opposing forces on the movable element 3. In the absence of further external forces, for example in a condition at rest, the movable element 3 is maintained in an intermediate position between the two limit stops 6, 7.

Also in this variant, by changing the rigidity of the elastic elements 13 it is possible to limit to a greater or lesser extent the movements of the movable element 3 with the same forces applied along a direction parallel to the axis X.

According to a further variant, both the limit stops 6, 7 can be of fixed type, i.e. their distance can be constant.

Figure 6:
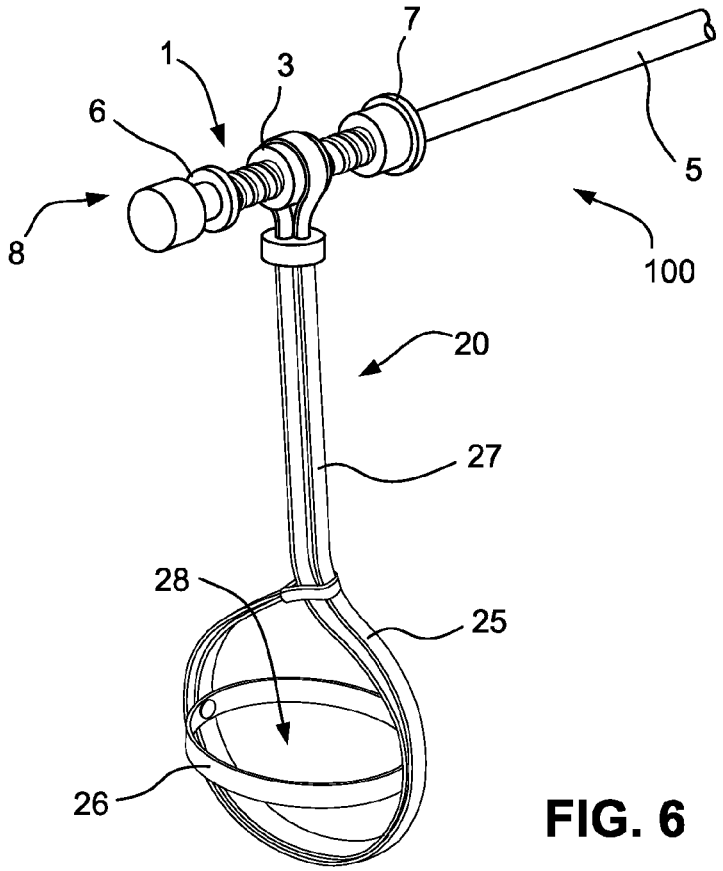
FIG. 6 is a perspective view of the spacer means according to another variant of the present invention.

FIG. 6 illustrates the spacer means 20 according to another variant of the invention.

This spacer means 20 comprises an elongated flexible element 27 connectable at one end to an exercise device 100.

More in detail, the elongated flexible element 27 can be connected to a device 1 such as that of the present invention or to any other device in the form of a bar, dumbbell or grip, or it can be gripped directly by a person.

The elongated flexible element 27 is preferably elastic.

A housing 28 for a mass, typically spherical in shape, for example a medicine ball or the like, is fastened to the opposite end of the elongated flexible element 27.

The housing 28 comprises at least two bands 25, 26 that surround the perimeter of the mass, preferably along direction crossing over each other. In practice, said bands 25, 26 form a sort of harness that surrounds the mass to maintain it suspended.

In the variant illustrated, one of said bands 25 comprises an extension of the elongated flexible element 27 that is bent and closed at said opposite end.

The bands 25, 26 can be made of the same material as the elongated flexible element or of different materials, for example not elastic. Plastic materials or synthetic or natural fibers are preferred.

The invention has been described purely for illustrative and non-limiting purposes, according to some preferred embodiments. Therefore, a person skilled in the art can make modifications or variations, all of which are considered as falling within the scope of protection of the present invention.

The invention claimed is:

1. An exercise device, connectable to a sporting device including at least one rod portion, said exercise device comprising:

at least one fixed structure extending at least partially longitudinally along an axis and connectable by an end portion to said rod portion of the sporting device, the at least one fixed structure comprising at least one bar portion, at least a first limit stop, and a free end;

a movable element connectable to said at least one fixed structure on the at least one bar portion to carry out at least a sliding translation movement with respect to the at least one fixed structure along said axis, the movable element configured to connect with a hanging mass such that the sliding translation movement of the movable element causes a variation of a point of application of the weight of the hanging mass on the exercise device, the movable element comprising a seat into which a spacer is configured to be placed to connect with the hanging mass, the movable element being attached on an outside surface of the at least one bar portion or attached as a sleeve around the at least one bar portion; and a coupling portion configured to connect to the sporting device, wherein the first limit stop is positioned at the free end or between the free end and the movable element.

2. The device according to claim 1, wherein the movable element comprises the sleeve inserted sliding on said bar portion.

3. The device according to claim 2, wherein the at least one fixed structure comprises a second limit stop positioned between said end portion and said movable element.

4. The device according to claim 2, wherein the movable element comprises a bearing system that slides on said bar portion, said bearing system being selected from a bushing made of plastic or metal material or roller or ball bearings.

5. The device according to claim 1, wherein the at least one fixed structure comprises a second limit stop positioned between said end portion and said movable element.

6. The device according to claim 5, wherein said second limit stop is movable along said axis.

7. The device according to claim 6, wherein said second limit stop comprises a threaded bushing screwed onto a threaded portion of the at least one fixed structure.

8. The device according to claim 7, wherein the movable element comprises a bearing system that slides on said bar portion, said bearing system being selected from a bushing made of plastic or metal material or roller or ball bearings.

9. The device according to claim 6, wherein the movable element comprises a bearing system that slides on said bar portion, said bearing system being selected from a bushing made of plastic or metal material or roller or ball bearings.

10. The device according to claim 5, further comprising an elastic element interposed between the movable element and at least one of the first limit stop and the second limit stop.

11. The device according to claim 5, wherein the movable element comprises a bearing system that slides on said bar portion, said bearing system being selected from a bushing made of plastic or metal material or roller or ball bearings.

12. The device according to claim 1, wherein the movable element comprises a bearing system that slides on said bar portion, said bearing system being selected from a bushing made of plastic or metal material or roller or ball bearings.

13. The device of claim 12, wherein the movable element further comprises an adjustable brake.

14. The device according to claim 1, further comprising a spacer connectable to and interposed between said movable element and the hanging mass that hangs from the movable element.

15. The device according to claim 14, wherein said spacer is flexible, and the flexible spacer is elastic.

16. The device according to claim 15, wherein the mass comprises a through hole in which at least one portion of said elastic spacer is housed.

17. A sporting device comprising:

the exercise device according to claim 1.

18. The sporting device according to claim 17, wherein the exercise device is fastened at an end of the at least one bar portion.

19. The sporting device according to claim 18, wherein said exercise device is connected to the mass by a flexible and elastic spacer.

20. The sporting device according to claim 19, wherein said spacer comprises an elongated flexible element connected at one end to the exercise device and having at an opposite end a housing for the mass, said housing comprising at least two bands configured to surround the perimeter of the mass along two directions crossing over each other to retain said mass.

* * * * *